US009661932B2

(12) United States Patent
Codos

(10) Patent No.: US 9,661,932 B2
(45) Date of Patent: May 30, 2017

(54) MATTRESS

(71) Applicant: Richard Codos, Warren, NJ (US)

(72) Inventor: Richard Codos, Warren, NJ (US)

( * ) Notice: Subject to any disclaimer, the term of this patent is extended or adjusted under 35 U.S.C. 154(b) by 0 days.

(21) Appl. No.: 14/695,063

(22) Filed: Apr. 24, 2015

(65) Prior Publication Data

US 2016/0270545 A1 Sep. 22, 2016

Related U.S. Application Data

(60) Provisional application No. 62/134,406, filed on Mar. 17, 2015.

(51) Int. Cl.

| | |
|---|---|
| ***A47C 27/06*** | (2006.01) |
| ***A47C 27/05*** | (2006.01) |
| ***A47C 27/07*** | (2006.01) |

(52) U.S. Cl.

CPC ..... *A47C 27/064* (2013.01); *A47C 27/05* (2013.01); *A47C 27/07* (2013.01)

(58) Field of Classification Search

CPC ..... A47C 27/064; A47C 27/062; A47C 27/06; A47C 27/04; A47C 23/04; A47C 23/043; A47C 23/064; A47C 23/065; A47C 27/05; A47C 27/053; A47C 27/056; A47C 27/14; A47C 27/148; A47C 27/15

USPC ..... 5/720, 716, 655.8, 655.7, 642, 654.1, 5/239, 241, 243, 245, 727, 728

See application file for complete search history.

(56) References Cited

U.S. PATENT DOCUMENTS

| | | | | | |
|---|---|---|---|---|---|
| 19,350 | A | * | 2/1858 | Crossman et al. | A47C 27/064 5/258 |
| 685,160 | A | | 10/1901 | Marshall | |
| 1,192,510 | A | | 7/1916 | Fischmann | |
| 1,906,893 | A | * | 5/1933 | Young | A47C 27/05 5/716 |
| 2,236,007 | A | | 3/1941 | Oldham | |
| 2,983,236 | A | | 5/1961 | Thompson | |
| 3,031,690 | A | * | 5/1962 | Ramsay | A47C 23/002 267/94 |
| 3,160,894 | A | * | 12/1964 | Frey | A47C 23/068 5/243 |
| 3,166,768 | A | * | 1/1965 | Cunningham | A47C 27/05 267/143 |
| 3,191,197 | A | * | 6/1965 | Frey | A47C 27/04 297/3 |
| 4,439,977 | A | | 4/1984 | Stumpf | |

(Continued)

FOREIGN PATENT DOCUMENTS

| | | | | |
|---|---|---|---|---|
| GB | WO 8102384 A1 | * | 9/1981 | A47C 23/002 |
| SE | EP 2789267 A1 | * | 10/2014 | A47C 27/064 |
| WO | WO2014166927 A1 | | 10/2014 | |

*Primary Examiner* — Robert G Santos

(74) *Attorney, Agent, or Firm* — Steven N. Fox, Esq.

(57) ABSTRACT

The present invention is a mattress comprising a plurality of pocket springs. Each of the pocket springs comprise a coil pocket and a first cushion pocket. The coil pocket comprises a pocket and a coil spring disposed therein. The first cushion pocket comprises a pocket and a resilient member disposed therein. The first cushion pocket is disposed above and acts directly upon the coil pocket. The mattress may further comprise a second cushion pocket disposed below the coil pocket. The second cushion pocket comprises a pocket and a resilient member disposed therein. The second cushion pocket is engaged with and acts directly upon the coil pocket.

10 Claims, 14 Drawing Sheets

(56) References Cited

U.S. PATENT DOCUMENTS

| | | | | | |
|---|---|---|---|---|---|
| 4,566,926 | A | | 1/1986 | Stumpf | |
| 5,070,560 | A | * | 12/1991 | Wilkinson | A47C 23/065 5/236.1 |
| 5,231,718 | A | | 8/1993 | Blaha | |
| 5,868,383 | A | | 2/1999 | Codos | |
| 6,041,459 | A | * | 3/2000 | Nunez | A47C 27/144 5/727 |
| 6,317,912 | B1 | | 11/2001 | Graebe | |
| 6,397,418 | B1 | * | 6/2002 | Stjerna | A47C 27/062 5/655.8 |
| 6,490,744 | B1 | | 12/2002 | Schulz, Jr. | |
| 6,948,205 | B2 | | 9/2005 | Van Der Wurf | |
| 7,082,635 | B2 | | 8/2006 | Barman | |
| 7,845,035 | B2 | * | 12/2010 | Letton | A47C 27/056 5/718 |
| 8,181,296 | B2 | | 5/2012 | Rawls-Meehan | |
| 8,266,745 | B2 | | 9/2012 | Mossbeck | |
| 8,474,078 | B2 | | 7/2013 | Mossbeck | |
| 8,932,692 | B2 | | 1/2015 | Pearce | |
| 2007/0044245 | A1 | * | 3/2007 | Bryant | A47C 27/056 5/727 |
| 2009/0089933 | A1 | * | 4/2009 | Letton | A47C 27/056 5/657 |
| 2010/0325806 | A1 | * | 12/2010 | Letton | A47C 27/056 5/691 |
| 2016/0045034 | A1 | * | 2/2016 | Hager | A47C 27/064 5/720 |
| 2016/0270545 | A1 | * | 9/2016 | Codos | A47C 27/064 |

* cited by examiner

MATTRESS

CROSS-REFERENCE TO RELATED APPLICATIONS

This application claims priority to U.S. Provisional Application Ser. No. 62/134,406 filed on Mar. 17, 2015, now pending, which is hereby incorporated into this specification by reference in its entirety.

BACKGROUND OF THE INVENTION

Referring to FIGS. 1 and 2, a conventional mattress 50 generally has a layer of pocket coil springs 57, alternatively know as Marshall Type Springs, engaged with a base 52. Mattress 50 further has cushion layers 53 and 54 disposed above pocket coil springs 57 and a mattress ticking cover 51. First described in U.S. Pat. No. 685,160, a Marshall Type Spring is a coil spring 56 encased in a material pocket 55. The pocket coil assemblies are made by inserting coil springs 56 into respective fabric coil pockets 55 that are usually strung together as a continuous pocket coil strip.

U.S. Pat. No. 2,236,007 discloses a Marshall Type Spring having fiber stuffing added into the core of the pocket coil spring to help absorb forces placed upon the actual pocket coil spring by absorbing some of those forces in the fiber filling material.

U.S. Pat. No. 8,266,745 discloses a Marshall Type Spring employing a fill material, including foam or fiber, residing in the pocket with the spring coil, to reduce and eliminate noise and prevent the fabric that surrounds the spring from getting sucked inside the pocket when a person gets onto or off of the bed.

What most pocket coil mattresses have in common is that the coil spring, contained in an individual fabric pocket, lies under a sheet or multiple sheets, of padding and cushioning material that provide initial loading softness, a softer sleeper feel, help in reducing localized high pressure interface points, reduce the sensation of lying directly on a metal spring, and help conform to body contours. Mattresses of this type are often flipped at some time interval to help mitigate and eliminate the problems associated with getting body imprints in one or more of the cushioning layers from the sleeper repeatedly lying in a similar position night after night.

Referring to FIG. 3, another shortcoming of having a single or multiple sheets of cushioning material 53 above a layer of pocket coils 58 is that compressive forces caused by the weight of a body 49 ("sleeper compressive forces") are transmitted in the plane of cushioning material 53, a plane that is generally at right angles and perpendicular to the vertical plane of the pocket coil unit. This results in the sleeper compressive forces being transferred laterally to adjacent pocket coils even though those same coils might not be subjected to direct sleeper forces. This creates an indentation well 60 that causes the sleeper to be drawn into the core of mattress 50 rendering mattress 50 uncomfortable for sleeping.

An additional problem of the indentation well effect occurs for a second sleeper utilizing the same mattress at the same time as the primary sleeper. The second sleeper can often be subjected to the indentation well effect of the primary sleeper and be subjected to forces that draw that sleeper into the same sleep space as the primary sleeper. Obviously, the inverse is also true and the primary sleeper can be drawn into the indentation well effect created by the secondary sleeper. Both of these situations result in a situation in which neither sleeper is able to get comfortable in his or her own space due to shortcomings in the way that sheet cushioning material behaves in a current mattress configuration.

A further shortcoming of the sheet cushioning above the pocket coil is that the sheet cushioning material takes on a trampoline effect when loaded from above. Rather than just acting as a cushioning material to provide initial loading softness, a softer sleeper feel, help in reducing localized high pressure interface points, and help in conforming to body contours, the sheet cushioning is often additionally acting like a trampoline and exhibiting its own spring effect. The magnitude of the trampoline effect usually correlates closely with the tensile strength of the cushioning material. The cushioning material is being held in place above pocket coil springs that are not being compressed and is resisting downward defection in areas that are being subjected to compressive forces due to the lateral, in plane, tensile strength of the material. In essence, the sheet cushioning material is acting like a spring unit in its own right due to the tensile strength trampoline effect. This effect is often at odds with the desire of the cushioning material to provide an initial softness to the sleeper. Concerning hospital and nursing home mattresses, a significant problem concerns patients developing decubitus ulcers from increased mattress interface pressures. A goal of the sheet cushioning above a pocket coil core in a hospital mattress is to reduce decubitus ulcer formation by reducing localized high patient interface pressures. However, the trampoline effect exerted by the sheet cushioning layers above the coil unit works to adversely impact this goal.

An added deficiency associated with sheet cushioning above the pocket coil concerns delivery of the mattress. It is well known within the industry that mattresses are normally shipped in a flat configuration in either a horizontal or vertical orientation. Bending the mattress during initial delivery and setup often results in mattresses being damaged and returned. Often the failure mechanism within the mattress is the result of the sheering, permanent dislodging, or deformation of the sheet cushioning material. Furthermore, the need to ship mattress in a flat orientation adds to both the expense and logistics involved in mattress shipping. Often it requires two men and a truck to deliver a mattress to a consumer. It would be inherently advantageous to be able to roll up and compress mattresses for shipping and eliminate the costs associated with shipping a flat mattress. Additionally, the cost of storage in terms of floor space for both the manufacturer and retailer would be greatly reduced if the mattress could be stored in a rolled up and compressed format.

An existing problem when sleeping on different sheeted cushioning materials, especially different types of foam including, but not limited to, polyurethane, latex, and memory foam, is that they have a tendency to cause the sleeper to feel uncomfortably warm or hot when lying on the mattress. This is partially due to the fact that many of these sheeted cushioning materials have insulating properties that restrict body cooling for those sleeper's body parts that are in direct contact with the mattress. Couple this property with the very nature of a sheet of cushioning material's inhibition of airflow through or around the cushioning material makes the cooling problem worse. The inability of a sleeper to properly regulate their temperature, coupled with the fact that a sleeper's wake-up mechanism is partially triggered via internal temperature regulation, can make the inclusion of sheeted cushioning materials in pocket coil mattresses a significant factor in poor sleep quality associated with the mattress.

One of the major causes of mattress failure is a degradation of the sheet cushioning materials. This is a direct result of fatigue softening that is particularly dominant in sheet foam cushioning materials that are subjected to shear loads consistent with sleeper forces exerted on the mattress. Over time and successive loading, the foam starts to lose its ability to resist compression. This degradation of the sheet cushioning materials has led mattress manufacturers to recommend flipping the mattress to mitigate and delay this degradation.

The sheet cushioning also acts to trap dust, dust mites, and potentially other microorganisms. Over an extended period of time this can become a serious health hazard, especially to those individuals who are highly allergic or immunosuppressed. Additionally, hospitals and nursing homes mitigate this problem by covering the mattresses with barrier fabrics.

SUMMARY OF THE INVENTION

One object of the present invention is to provide a mattress that was not prone to formation of indentations.

Another object of the present invention was to develop a mattress that allows air circulation in the core of the mattress providing a cooler mattress for sleeping.

Another object of the invention was to develop a mattress having pocket springs that allow the softness or hardness of the mattress to be selectively controlled.

Another object of the present invention was to develop a mattress that could be easily fabricated as a one sided or two sided mattress and with potential different comfort profiles for each side.

Another object of the invention was to develop a mattress that better isolates sleeper movements.

Another object of the invention was to develop a mattress that eliminates sheet cushioning layers that are subject to shear forces from sleeper compressive loads and their resultant premature failure resulting in a longer life mattress.

Another object of the invention was to develop a mattress that replaces the sheet cushioning with individually encased foam cushion pockets. Since the cushioned pockets are individually encased in a fabric, and the cushion pockets are inherently impervious to trapping dust, dust mites, and other microorganisms, the health hazards associated with sheet cushioning materials on conventional mattresses are substantially reduced.

Another object of the invention was to develop a mattress that reduces the quantity of cushioning material from between 20% to 25% relative to an existing pocket coil mattress that utilizes sheet foam cushioning material, thereby reducing corresponding cost and weight associated with the additional sheet cushioning material. This is accomplished by utilizing the improved pocket coil spring that has cushioning material that only lies directly above the spring unit in the cushioning pocket.

Another object of the invention was to develop a mattress that eliminates sheet cushioning layers that have been linked to the development of decubitus ulcers in patients in nursing homes and hospitals.

The present invention is a mattress comprising a plurality of pocket springs. Each of the pocket springs comprise a coil pocket and a first cushion pocket. The coil pocket comprises a pocket and a coil spring disposed therein. The first cushion pocket comprises a pocket and a resilient member disposed therein. The first cushion pocket is disposed above and acts directly upon the coil pocket. The mattress may further comprise a second cushion pocket disposed below the coil pocket. The second cushion pocket comprises a pocket and a resilient member disposed therein. The second cushion pocket is engaged with and acts directly upon the coil pocket. The present invention provides significant benefits over conventional mattresses. First, the pocket springs significantly reduce the formation of indentations thereby providing a new mattress with increased comfort and useful life than conventional mattresses. Second, the pocket springs provide better air circulation than conventional mattresses thereby resulting in the sleeper sleeping cooler. Third, the pocket springs allow the softness or hardness of the mattress to be selectively controlled thereby resulting in more mattress choices for consumers. Fourth, the pocket springs allow a single sided or a two sided mattress to be easily fabricated. Fifth, the pocket springs minimize the transmission of sleeper compressive forces in the plane that is orthogonal to that of the pocket springs helping to better isolate sleeper movements. Sixth, the pocket springs eliminate sheet cushioning layers that are subject to shear forces from sleeper compressive loads and their resultant premature failure, resulting in a longer life mattress.

BRIEF DESCRIPTION OF THE DRAWINGS

The following description of the present invention will be better understood with reference to the accompanying drawings in which.

DESCRIPTION OF THE INVENTION

Figure 1:
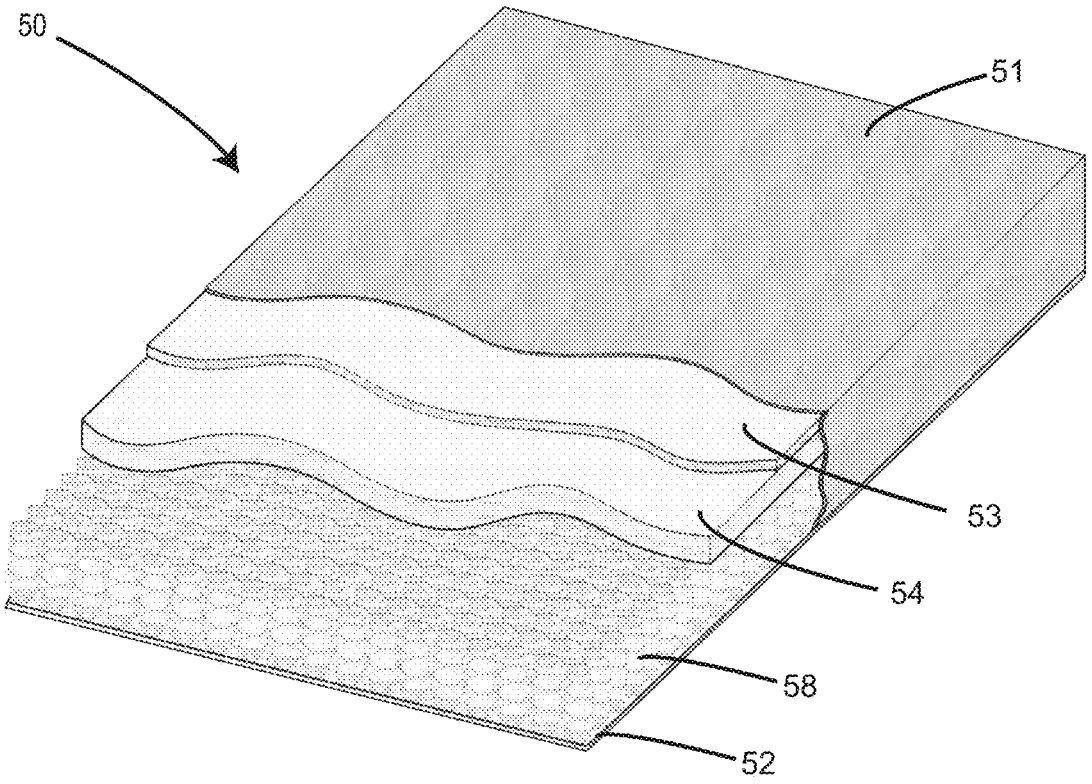
(prior art) Fig 1
FIG. 1 is a perspective view of a prior art pocket coil spring having a pocket and a coil spring disposed in the pocket.
Figure 2:
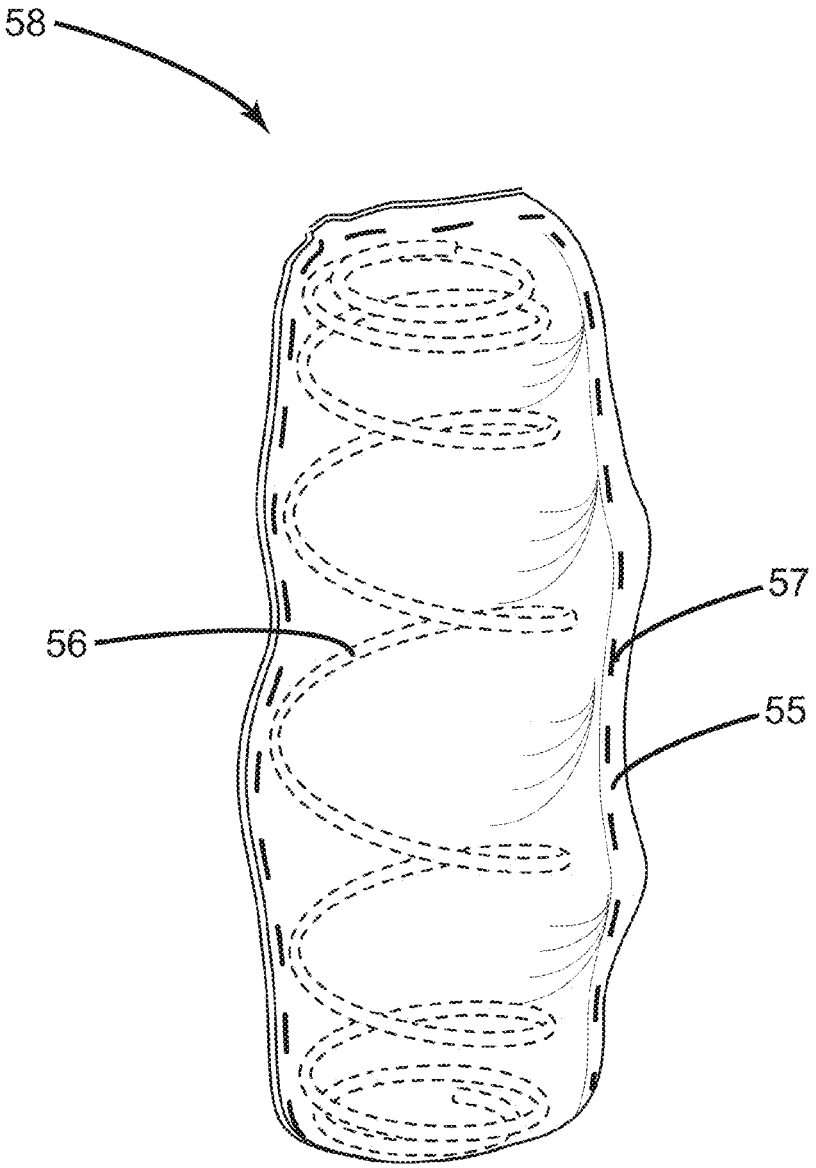
(prior art) Fig 2
FIG. 2 is a perspective view of a prior art mattress having a plurality of pocket coil springs and a plurality cushioning sheets or layers.
Figure 3:
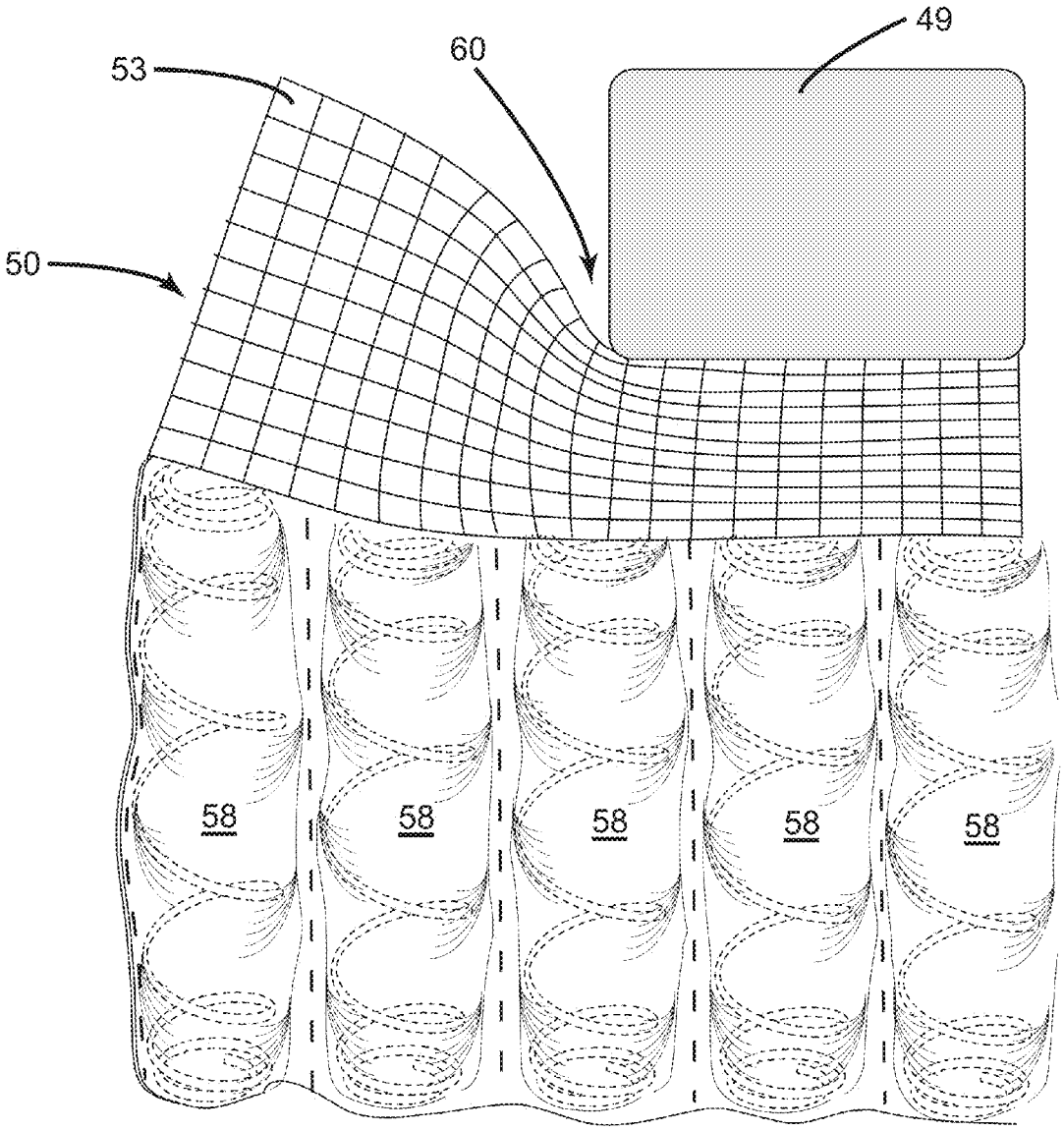
(prior art) Fig 3
FIG. 3 is an illustration of a conventional mattress with the formation of an indentation well.
Figure 4:
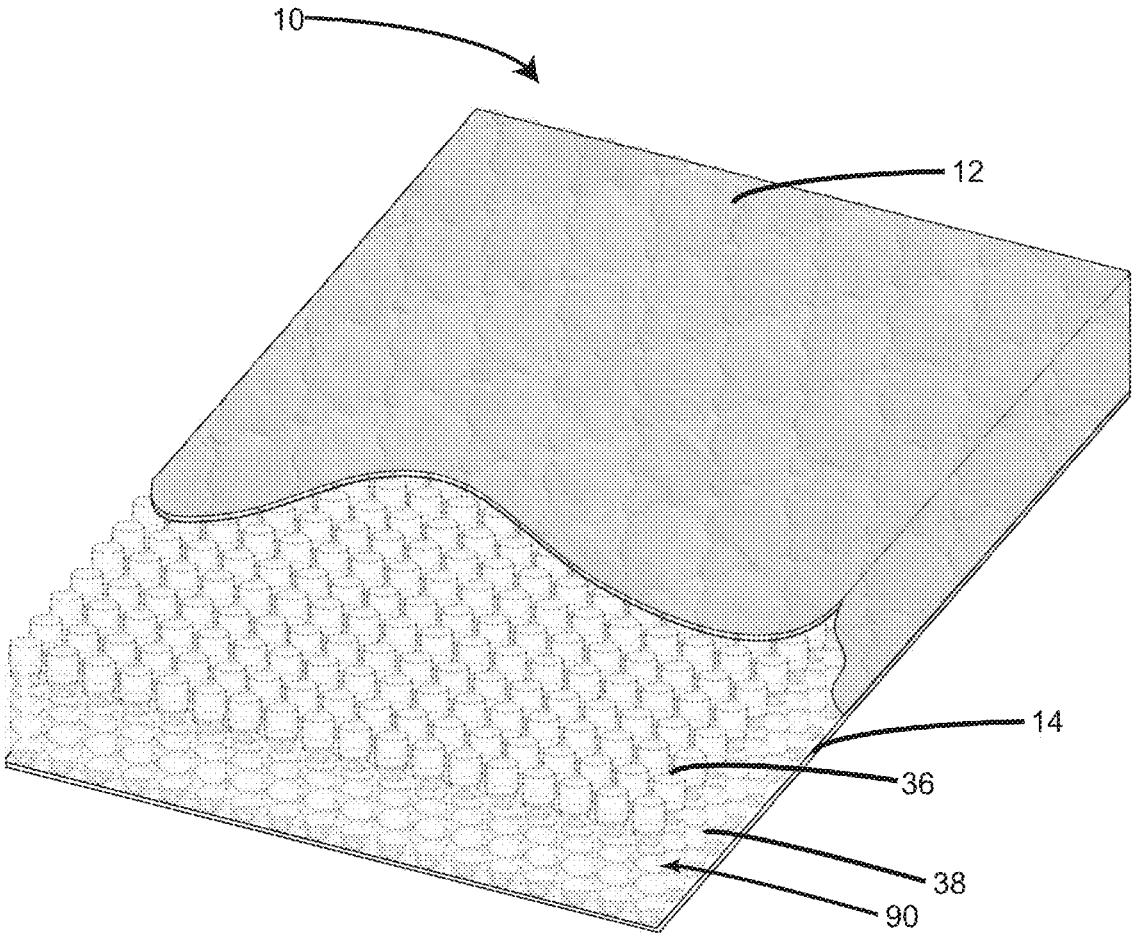
FIG. 4 is a perspective view of a one-sided mattress according to a first embodiment of the invention, in an unloaded state, showing a plurality of pocket springs each comprising a coil pocket and a cushion pocket engaged with and acting upon the coil pocket.

Referring to FIG. 4, where a mattress 10 according to a first embodiment of the present invention generally comprises a plurality of pocket springs 90 arranged in rows and columns on a base 14. Each of pocket springs 90 comprise a cushion pocket 36 disposed above and juxtaposed to a coil pocket 38. As will be described more fully herein, cushion pocket 36 is engaged with and acts directly upon coil pocket 38. Pocket springs 90 are covered on their top and sides by a mattress ticking cover 12. In this embodiment, there are no other layers of cushioning material between mattress ticking 12 and cushion pocket 36 other than the fiber filler material that can be a part of a quilted mattress ticking cover 12. In the embodiment shown, mattress 10 is a single sided or no flip mattress. However, as will be shown in additional embodiments, mattress 10 may be a two sided or reversible mattress that does not require base 14. Mattress 10 may be of size such as single, queen or king size. For a single size, mattress 10 would have about 294 pocket springs 90.

Figure 5:
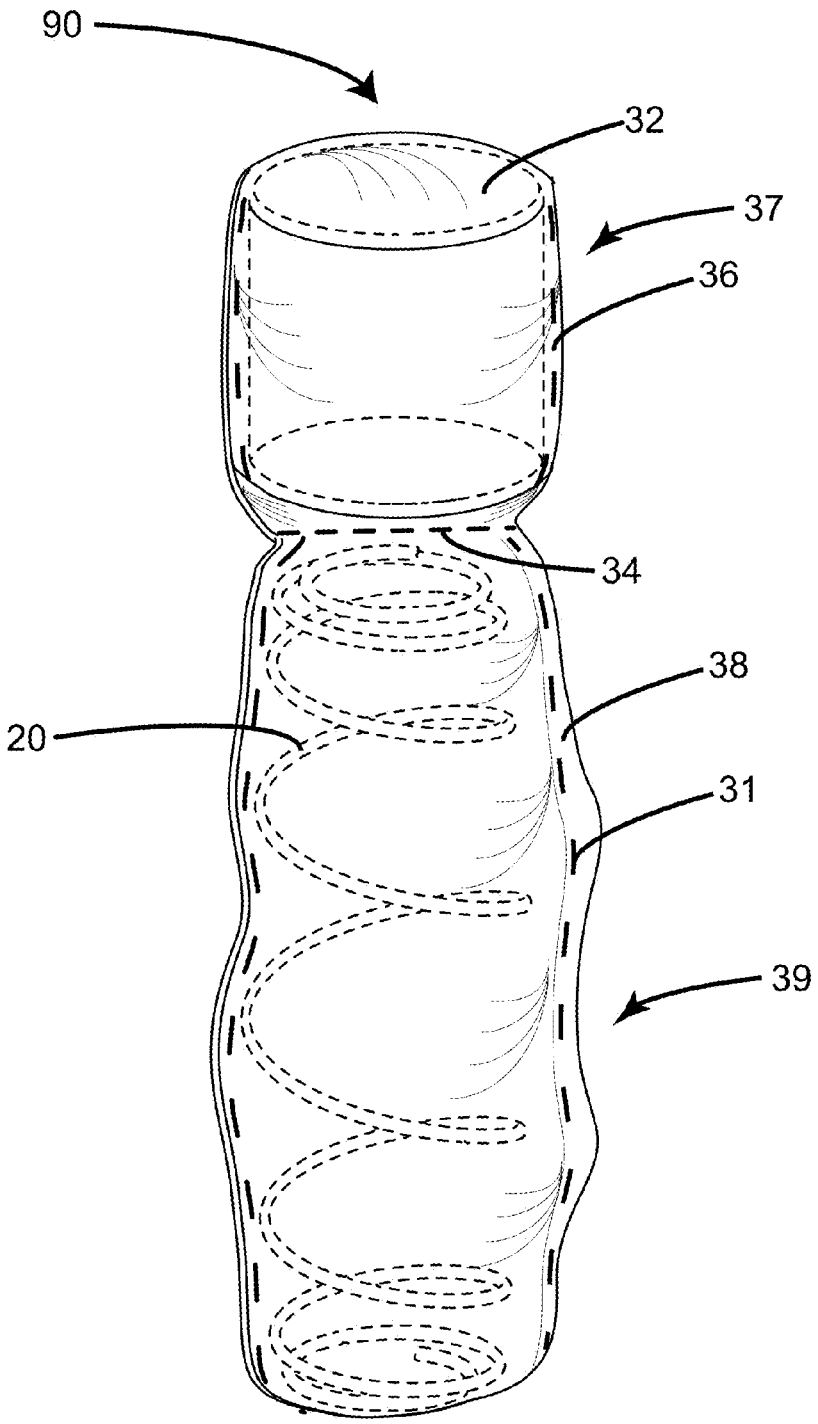
FIG. 5 is a perspective view of a pocket spring according to the first embodiment of the present invention, in an unloaded state, showing a cushion pocket engaged with and acting upon a coil pocket having a single-rate spring coil.

Referring to FIG. 5, where pocket spring 90 is shown with cushion pocket 36 disposed above and juxtaposed to coil pocket 38. This particular embodiment of pocket spring 90 is utilized in a single sided, no flip, mattress. Cushion pocket 36 produces a force when depressed by the weight of a person. Cushion pocket 36 is engaged with and directly acting upon coil pocket 38 such that substantially all of the force from cushion pocket 36 is transmitted to coil pocket 38. In this embodiment, coil pocket 38 comprises a pocket 39 and a spring 20 disposed within pocket 39. In the embodiment shown, spring 20 is a single rate barrel spring. Spring 20 may be any other type of conventional or futurely developed coil spring. By way of example only, spring 20 may be a multi-rate coil spring available under the brand name SOFT TOUCH® from Leggett & Plat Components Europe Limited, P.O. Box 681, Barnsley, S72 7WB, United Kingdom. (www.lpeurope.com/softtouch.asp). Pocket 39 may be sealed on its sides by an ultrasonic thermal bond 31. However, spring 20 could also be sealed within pocket 39 by, but not limited to, a sewn seal or an adhesive pocket seal. In this embodiment, pocket 39 is a nonwoven polyester fabric. However, many other fabrics can be used in this invention, including but not limited to, woven fabrics such as cotton, polyester, polypropylene, nylon, and fabric blends, along with nonwoven fabrics composed of polyester, polypropylene, nylon, and fabric blends. Cushion pocket 36 comprises a pocket 37 and a resilient member 32 disposed in pocket 37. Pocket 37 is fashioned from the same continuous piece of fabric that is used to fashion pocket 39 of coil pocket 38. In this embodiment, resilient member 32 is a cylindrical piece of open cell foam that resides within pocket 37 of cushion pocket 36, and pocket 37 is formed with the same ultrasonic bond 31 that formed pocket 39 of coil pocket 38. The open cell foam is available from a variety of sources such as the Foam Factory, Inc., 17500 23 Mile Road, Macomb, Mich. 48044 (http://www.thefoamfactory.com/opencellfoam/supersoft.html). Although a 4 lb per cubic foot density open cell viscoelastic foam is used as resilient member 32, many other types of foam and cushioning materials could be individually, or in some combination, contained within cushion pocket 36. They can include, but are not limited to, different density and thickness viscoelastic foam, latex foam, poly foam, poly fiber, down fiber, wool fiber, or some combination of the aforementioned. Furthermore, in this embodiment, a separation between pocket 39 of coil pocket 38 and pocket 37 of cushion pocket 36 is made with an ultrasonic thermal separation bond 34. However, it is possible to create this separation between cushion pocket 36 and coil pocket 38 with, but not limited to, a sewn separation or an adhesive line separation. In this particular embodiment, coil pocket 38 is seven inches in length topped by cushion pocket 36 that is three inches in length. The width of coil pocket 38 is approximately 2.75 inches, while the width of cushion pocket 36 is approximately 2.5 inches. However, many other length and width combinations of cushion pocket 36, and coil pocket 38, are acceptable and in no way limit the scope of this invention.

Figure 6:
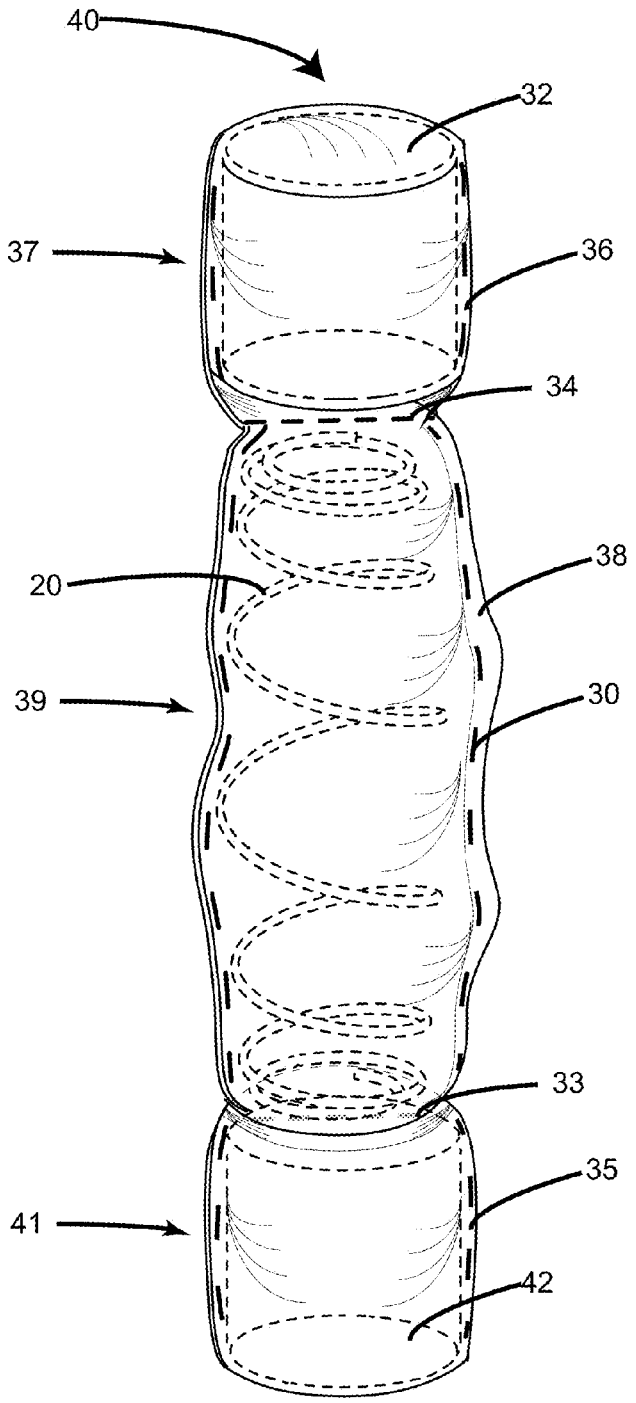
FIG. 6 is a perspective view of a pocket spring according to another embodiment of the present invention, in an unloaded state, showing a first cushion pocket engaged with and acting upon an upper portion of a coil pocket and a second cushion pocket engaged with and acting upon a lower portion of the coil spring.

Referring to FIG. 6, where in another embodiment, pocket spring 90 comprises a cushion pocket 36 on one side of and juxtaposed to coil pocket 38 and a cushion pocket 35 on the other side of and juxtaposed to coil pocket 38. Cushion pocket 35 comprises a pocket 41 and a resilient member 42 disposed in pocket 41. This particular embodiment can be utilized in, but not limited to, a two sided or reversible mattress. In this and other embodiments, resilient member 32 contained in cushion pocket 36 may be the same or different from resilient member 42 contained in cushion pocket 35. This would effectively allow the end user to flip the mattress and have a totally different cushioning response from one side of the mattress to the other. By the same token, the actual geometry of the cushion pockets can be different, with cushion pocket 36 potentially having a different diameter and, or length than that of cushion pocket 35. This would also create a different mattress cushioning profile, depending on which side of the mattress is in direct contact with the sleeper. Further to this embodiment, both coil pocket 38, cushion pocket 36, and cushion pocket 35 are formed from a single piece of fabric and made with an ultrasonic thermal separation bond 34 in the case of cushion pocket 36, and a similar ultrasonic thermal separation bond 33 (not clearly visible in the drawing) in the case of cushion pocket 35. However, it is also envisioned that either one, or both cushion pockets could be formed from a separate piece of material and bonded to coil pocket 38 by any one of a number of known bonding means. Furthermore, the separation bonds between the cushion pockets 36 and 35, and the coil pocket 38, can be but are not limited to, a sewn separation or an adhesive line separation. This embodiment is not limited to a single cushion pocket on each side of the coil pocket. Additionally, more than one cushion pocket can be stacked on top of one another or side-by-side above a coil pocket to create different cushioning profiles for each side of a flippable mattress.

Figure 7:
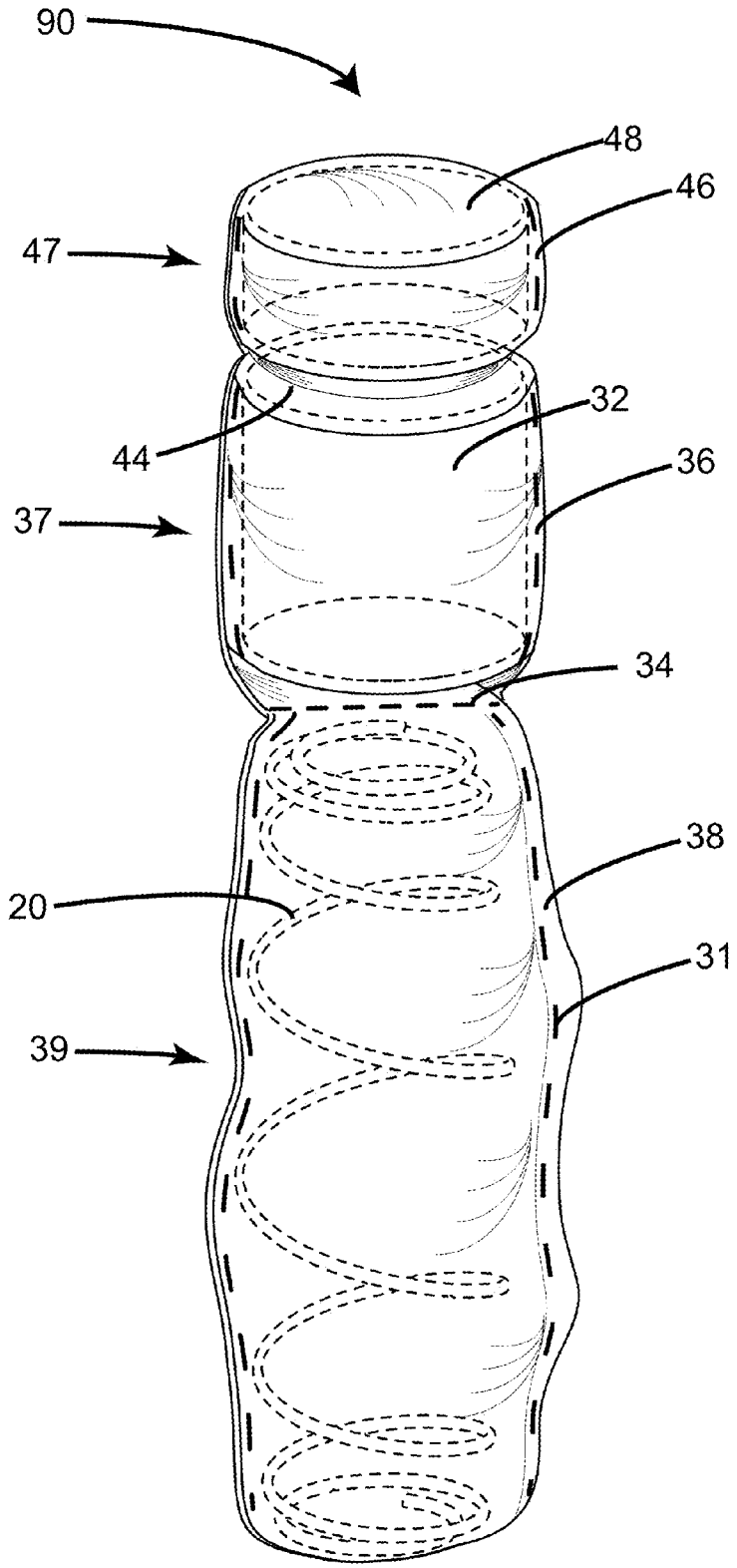
FIG. 7 is a perspective view of a pocket spring according to another embodiment of the present invention, in an unloaded state, showing a first cushion pocket engaged with and acting upon a coil pocket and a second cushion pocket engaged with and acting upon the first cushion pocket.

Referring to FIG. 7, where in another embodiment, pocket spring 90 comprises a cushion pocket 36 on one side of coil pocket 38 and a cushion pocket 46 on top of cushion pocket 36. Cushion pocket 46 comprises a pocket 47 and a resilient member 48 disposed in pocket 47. This particular embodiment is utilized in a single sided, no flip, mattress. As seen in this embodiment, more than one cushion pocket can be stacked on top of one another to create different cushioning profiles. Although this particular embodiment shows two cushion pockets 46 and 36 stacked upon coil pocket 38, this is not a limitation and it is envisioned that some other multiple number of cushion pockets could be further stacked upon one another. It can also be seen that cushion pocket 46 has a shorter length than cushion pocket 36. As is visible in this embodiment, the actual geometry of the cushion pockets can be different, with cushion pocket 36 potentially having a different diameter and, or length than that of cushion pocket 46. Further to this embodiment, both coil pocket 38, cushion pocket 36, and cushion pocket 46 are formed from a single piece of fabric and made with an ultrasonic thermal separation bond 34 in the case of cushion pocket 36, and a similar ultrasonic thermal separation bond 44 (not clearly visible in the drawing) in the case of cushion pocket 46, which is separated from cushion pocket 36. However, it is also envisioned that either one, or both cushion pockets could be formed from a separate piece of material and bonded to coil pocket 38, and to the other cushion pocket by any one of a number of known bonding means. Furthermore, the separation bonds between cushion pockets 36 and 46, and coil pocket 38, can be, but are not limited to, a sewn separation, thermal bond separation, or an adhesive line separation. It should be further noted that many length and width combinations of cushion pocket 36, cushion pocket 46, and coil pocket 38, are acceptable and in no way limit the scope of this invention.

Figure 8:
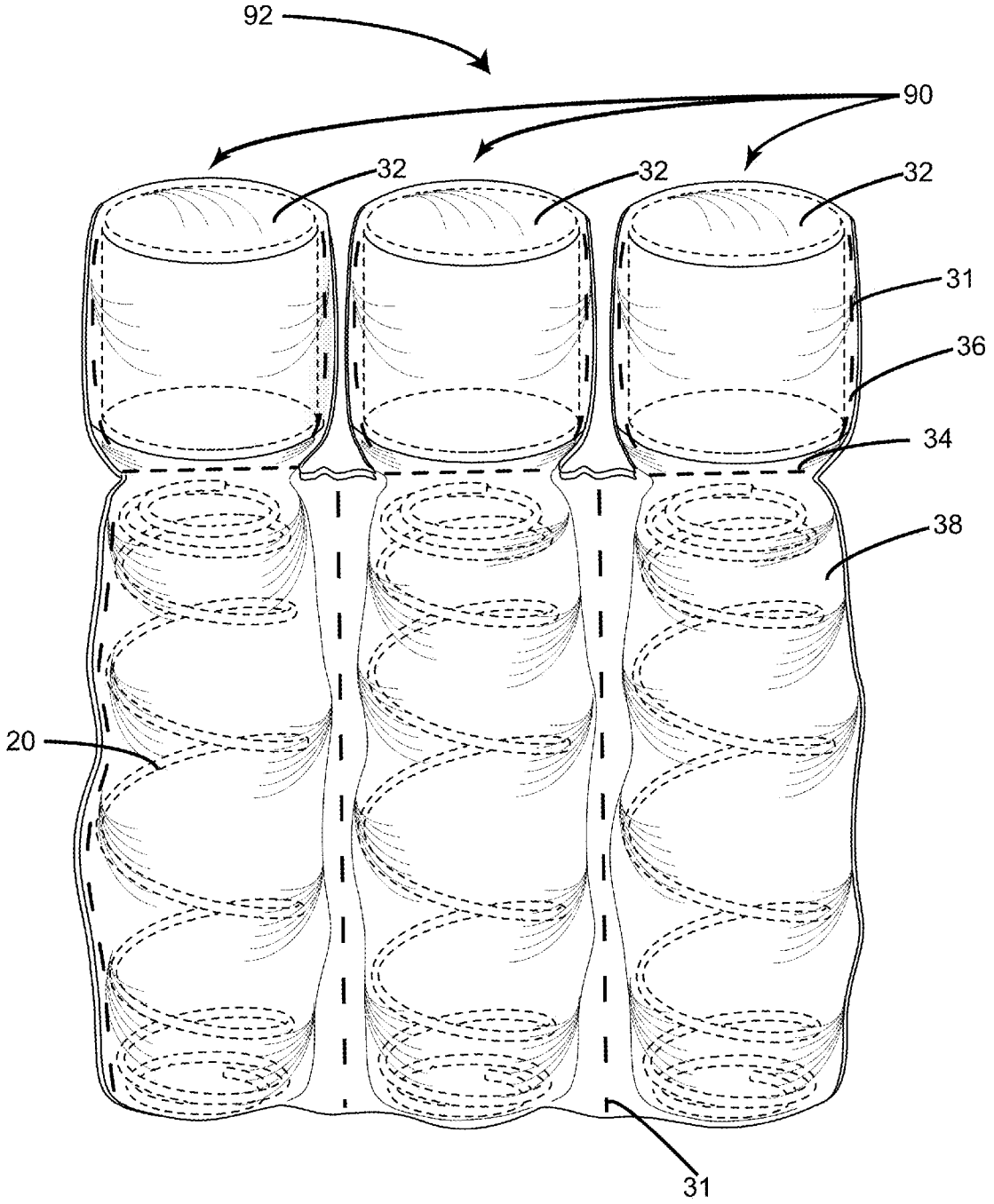
FIG. 8 is a perspective view of a pocket spring unit according to the present invention, in an unloaded state, showing a plurality of pocket springs each comprising a coil pocket and a cushion pocket engaged with and acting upon the coil pocket. Each of the coil pockets are connected with an adjoining coil pocket while each of the cushion pockets are free standing.

Referring to FIG. 8, where a partial continuous string or unit 92 is shown comprising a plurality of pocket springs 90 fabricated from a continuous length of fabric. The individual coil pockets 38, are separated from the next or preceding coil pocket by an ultrasonic thermal weld 31. Cushion pockets 36 are also formed from the same continuous piece of fabric as coil pockets 38. It should be noted that in this embodiment, after the cushion pockets 36 are formed by ultrasonic thermal welding 31, and the pocket delineation weld 34, they are then separated from the adjoining cushion pocket by cutting the fabric between their respective thermal welds. It is also possible to form the cushion pockets 36, from a separate continuous piece of fabric and secure this cushion pocket strip to the pocket coil strip by any of known means which include but are not limited adhesive bonding, thermal welding, or sewing. In other embodiments, the cushion pockets may remain connected to one another with the fabric between each cushion being flexible enough to allow independent movement of each cushion pocket. It is additionally possible to form each cushion pocket 36 from its own piece of fabric and secure it to a coil pocket 38 by one of the aforementioned means. In this embodiment, cushion pockets 36 are not connected to each other thereby allowing each cushion pocket to act directly upon its corresponding coil pocket and to allow air circulation within the mattress. Resilient member 32 cushion pocket 36 of first pocket spring 90 comprises a resiliency R1. Resilient member 32 of cushion pocket 36 of second pocket spring 90 comprises a resiliency R2. In this embodiment, resiliency R1 is equal to resiliency R2. In other embodiments, resiliency R1 may be greater or less than resiliency R2. Different values for resiliency R1 and resiliency R2 provide the ability to selectively design different comfortable levels.

Figure 9:
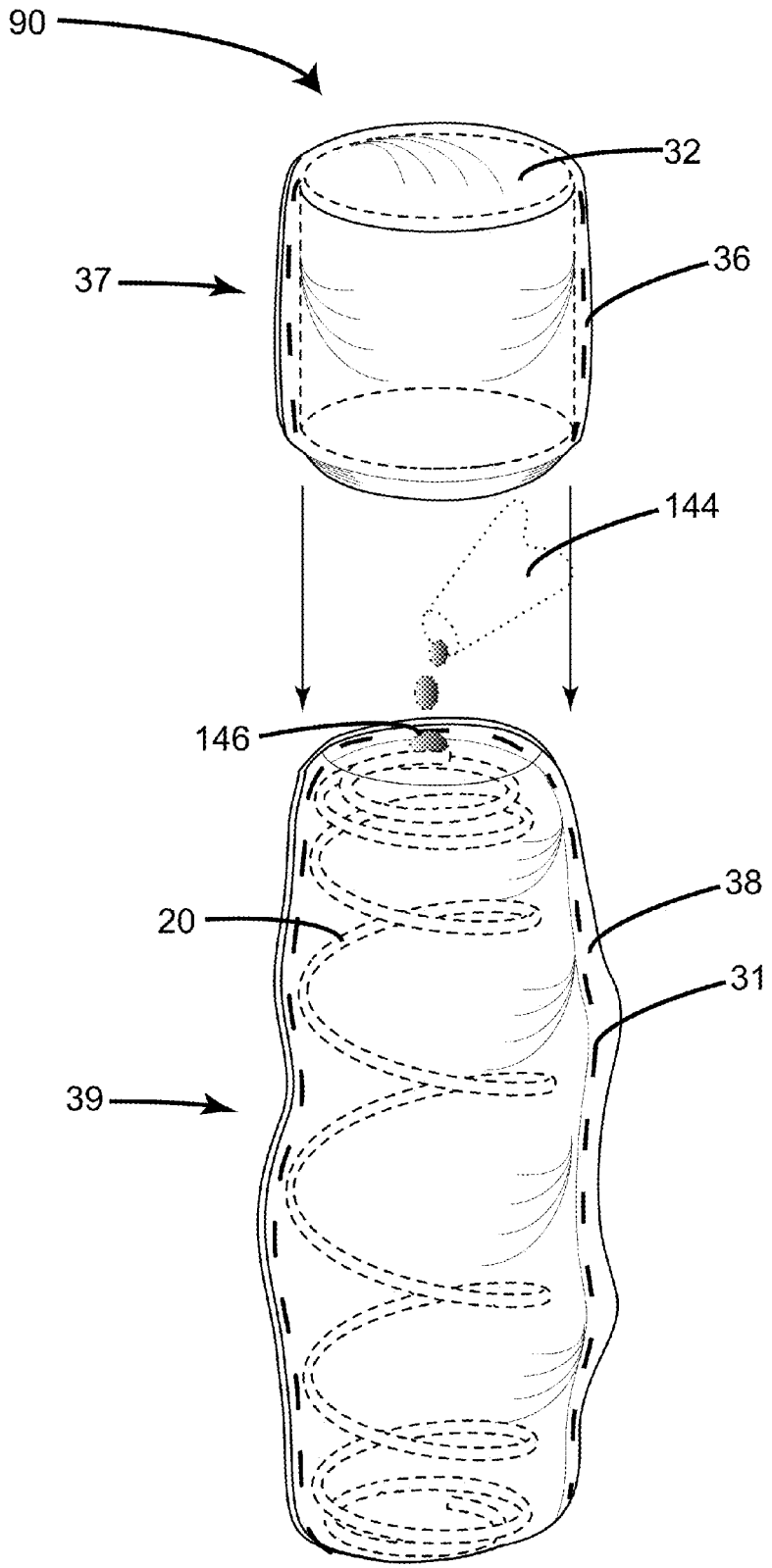
FIG. 9 is an exploded view of another embodiment of a pocket spring showing a coil pocket and a cushion pocket in the process of being attached to the coil pocket by adhesive.
Figure 10:
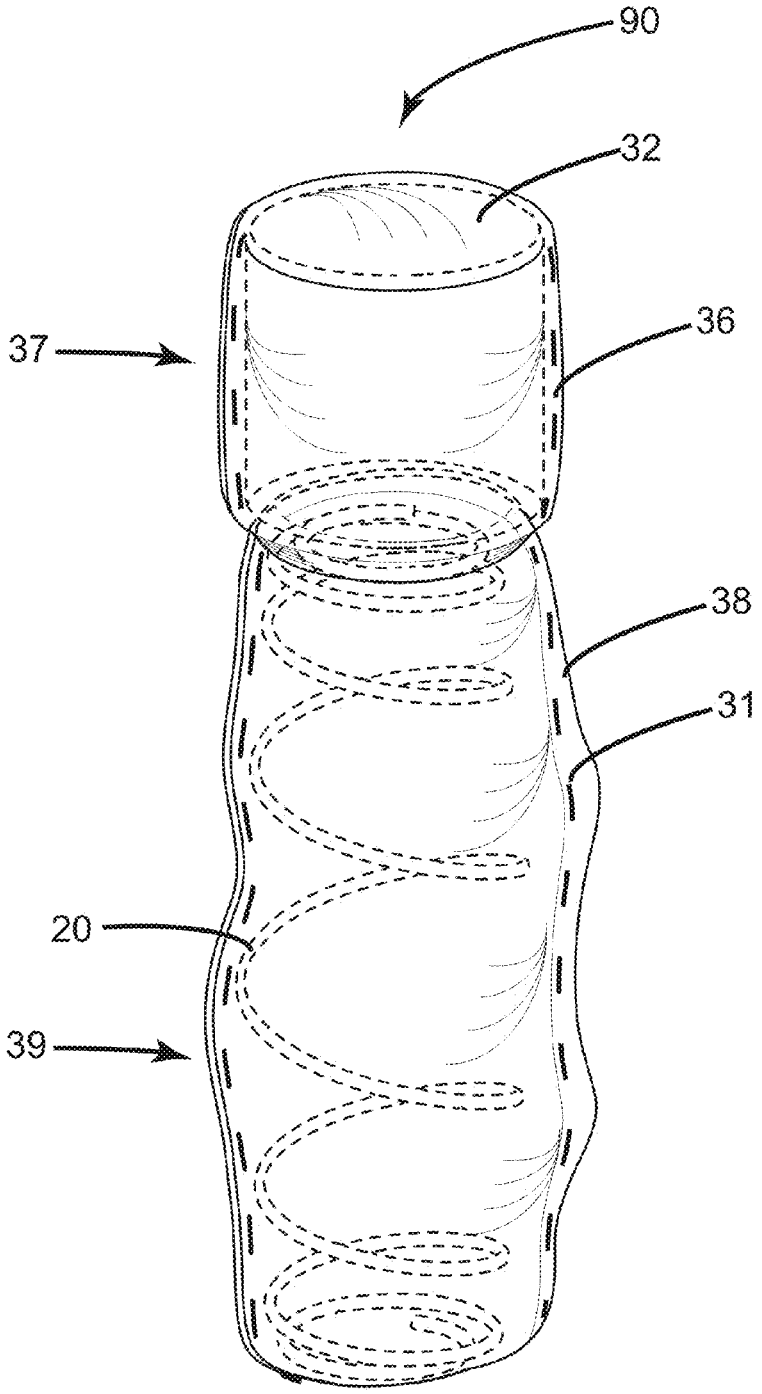
FIG. 10 is an perspective view of the spring pocket of FIG. 9 showing the cushion pocket attached to the coil pocket by adhesive.

Referring to FIGS. 9-10, where in another embodiment, pocket spring 90 is formed by hot melt adhesive bonding a cushion pocket 36 to a coil pocket 38. The complete pocket spring 90 is shown in FIG. 9. An adhesive applicator 144 is shown dispensing a hot melt adhesive 146 to the top of a previously formed coil pocket 38. A previously formed cushion pocket 36 is then lowered onto coil pocket 38 to form a completed pocket spring 90.

Figure 11:
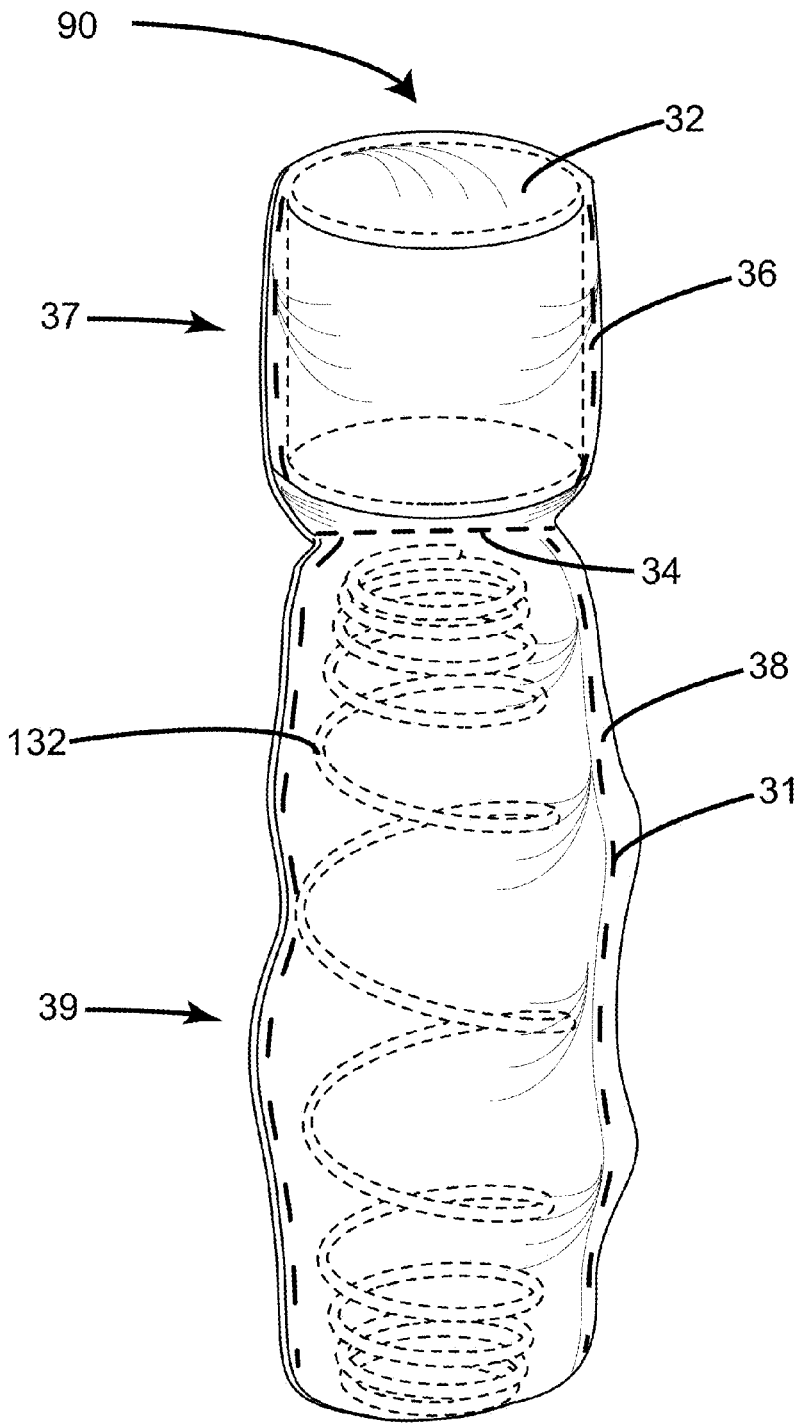
FIG. 11 is a perspective view of a pocket spring according to a first embodiment of the present invention, in an unloaded state, showing a cushion pocket engaged with and acting upon a coil pocket having a multi-rate spring coil.

Referring to FIG. 11, where in another embodiment, pocket spring 90 employs a multi-rate coil spring 132 as the spring element in coil pocket 38. Multi-rate coil spring 132 could additionally be used in any of the aforementioned embodiments that utilize more than one cushioning pockets located on one, or both sides of the coil pocket as previously described.

Figure 12:
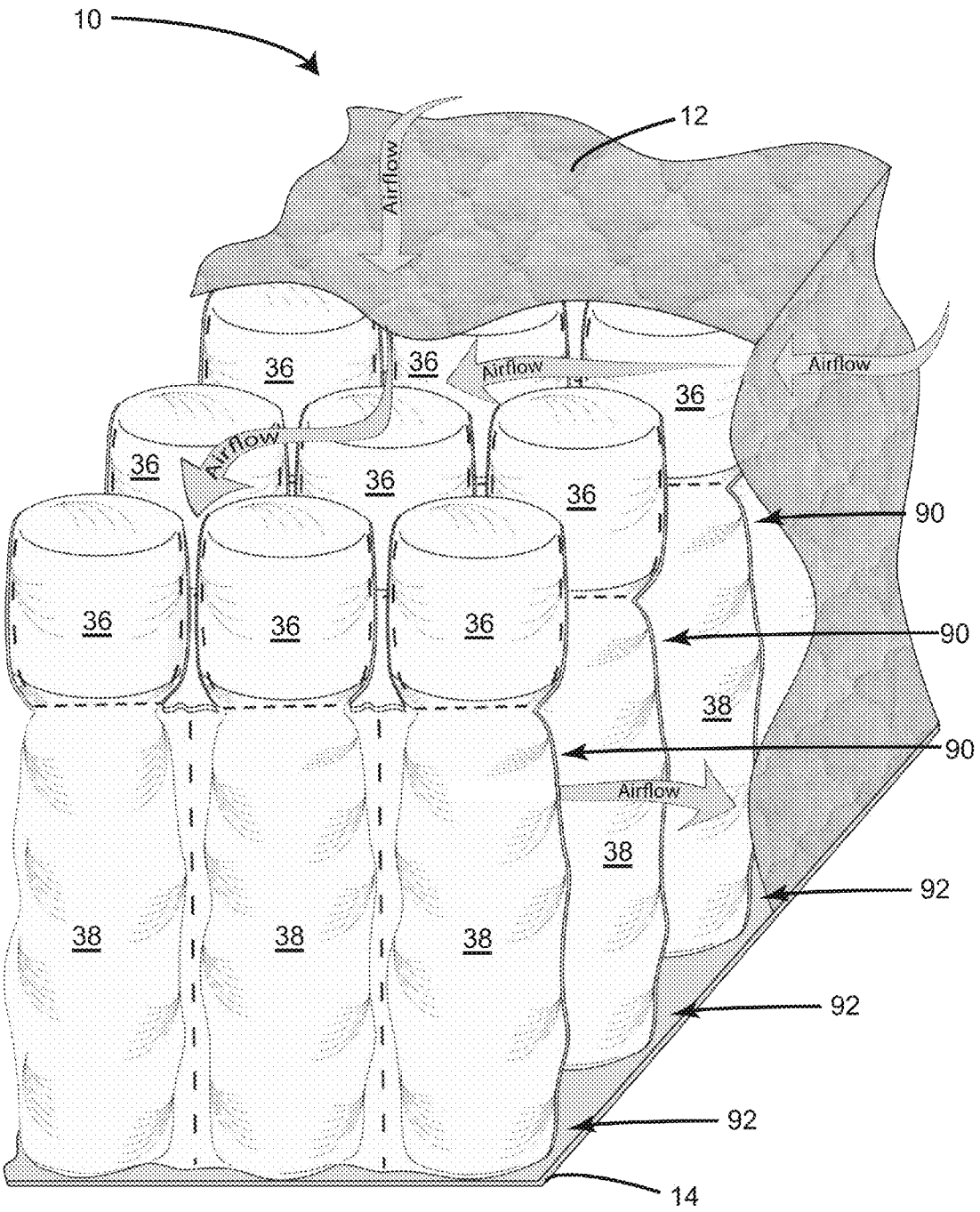
FIG. 12 is a perspective view of a mattress according to another embodiment of the invention showing, in an unloaded state, a plurality of pocket springs each comprising a coil pocket and a cushion pocket engaged with and acting upon the coil pocket. Each of the coil pockets are connected with an adjoining coil pocket while each of the cushion pockets are free standing allowing air circulation around the cushion pockets.

Referring to FIG. 12, where in another embodiment, mattress 10 comprises a plurality of pocket units 92 (previously described) arranged in rows and/or columns. As shown, pocket units 92 provides improved airflow around cushion pocket 36 of each pocket spring 90 and adjacent coil pockets 36. As can be seen in this drawing, air permeates quilted cover 12 and is able to freely circulate between adjacent cushion pockets 36 and between adjacent coil pockets 38. This is due to the fact that there are no cushioning sheets that act to block and restrict airflow into and out of the mattress core. It is also possible to have cushion pockets 36 joined to each other with excess material that still allows them to individually act on their respective coil pocket and still allow air circulation into and out of the mattress core.

Figure 13:
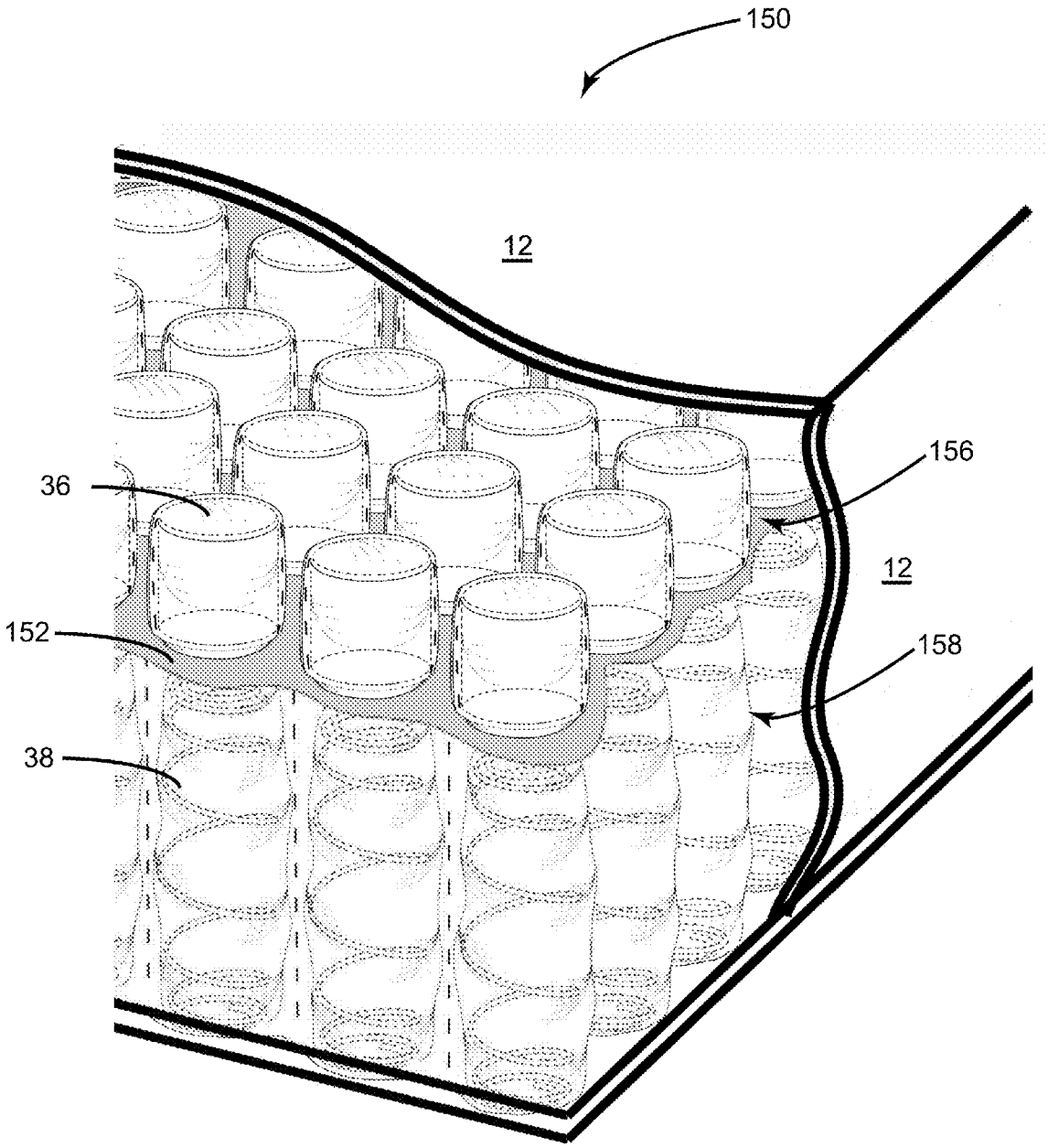
FIG. 13 is a perspective view a mattress according to another embodiment of the invention showing, in an unloaded state, a layer of coil pockets and a layer of cushion pockets. Each of the cushion pockets are engaged with and acting upon corresponding coil pockets. In this embodiment the cushion pockets are bonded to a fabric sheet to form the layer of cushion pockets.

Referring to FIG. 13, where in another embodiment of the invention, a mattress 150 comprises a layer of cushion pockets 156 composed of individual cushion pockets 36 that is distinctly separate from a layer of coil pockets 158 composed of coil pockets 38. In this embodiment, cushion pockets 36 are bonded to an attachment member 152 that in the embodiment shown is a fabric sheet. The method of bonding cushion pockets 36 to attachment member 152 may be, but is not limited to, thermal bonding or adhesive bonding. The spacing and location of cushion pockets 36 is such that each cushion pocket is located directly above a coil pocket 38 that it is directly acting upon. In this embodiment, attachment member 152 is used to locate and secure cushion pockets 36 above coil pocket 158. However, other means of locating and securing the layer of cushion pockets 156 above the layer of coil pockets 158 may be employed. For example, it would be possible to locate attachment member 152 above cushion pockets 36, or alternatively between the cushion pockets. It is further possible that attachment member 152 can be composed of, but is not limited to, a porous material that is air permeable, or perforated, therefore not restricting airflow between the layer of coil pockets 158 and the layer of cushion pockets 156.

Figure 14:
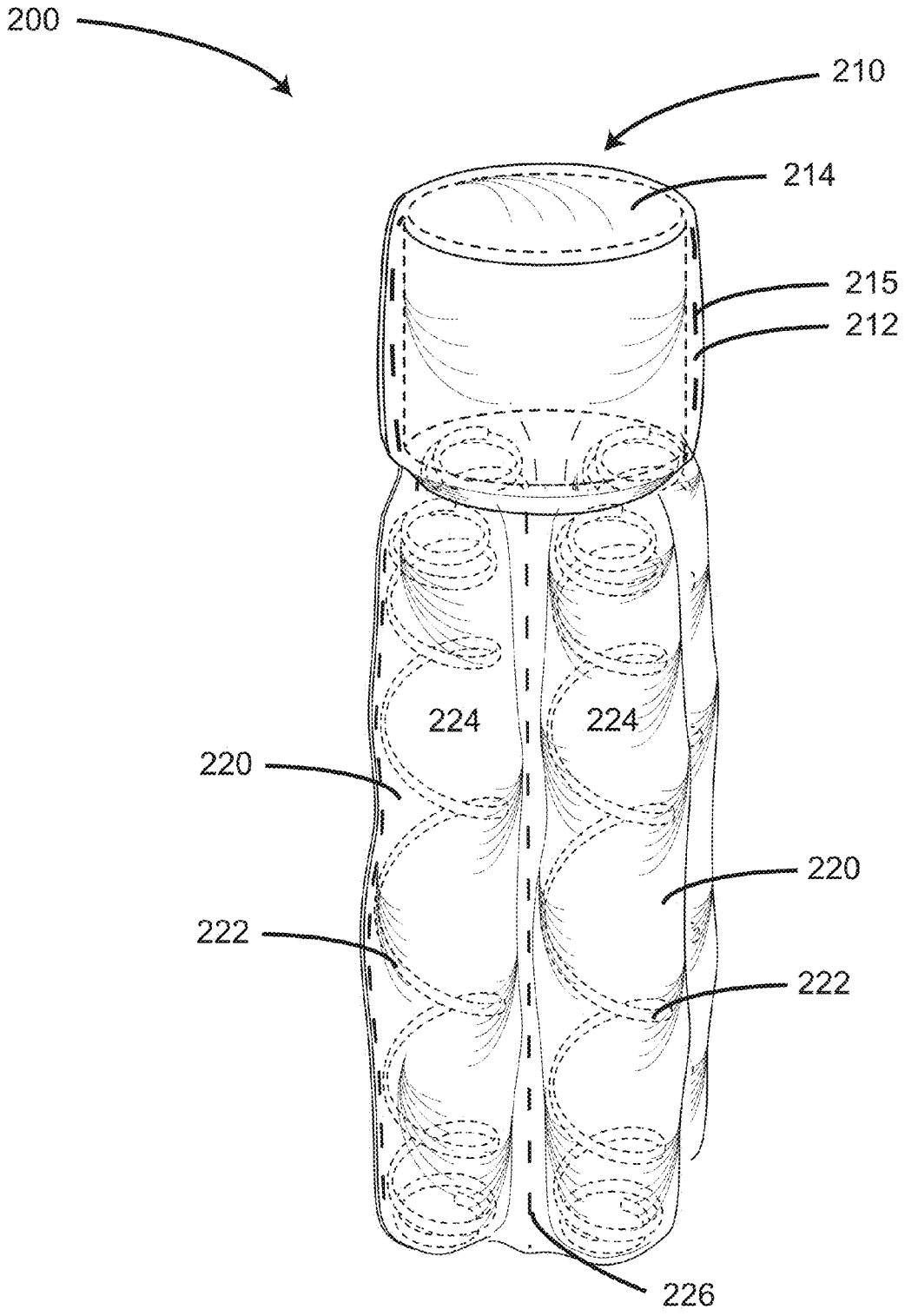
FIG. 14 is a perspective view of another embodiment of a pocket spring unit according to the present invention, in an unloaded state, showing a cushion pocket engaged with and acting directly upon a plurality of micro coil pockets.

Referring to FIG. 14, where in another embodiment, a pocket spring unit 200 according to the present invention generally comprises a cushion pocket 210 engaged with and acting directly upon a plurality of micro coil pockets 220. In the embodiment shown, cushion pocket is disposed above and juxtaposed to micro coil pockets 220. Each of micro coil pockets 220 comprise a pocket 224 and micro coil spring 222. Cushion pocket 210 comprises a pocket 212 and a resilient member 214 disposed in pocket 212. Pocket 212 is sealed by a thermal weld 215. Cushion pocket 210 is engaged with and acting directly upon micro coil pockets 220 such that substantially all of the force from cushion pocket 210 is transmitted to micro coil pockets 220. The pockets 224 of micro coil pockets 220 may be connected together by thermal weld 226. As in other embodiments, pocket 224 of micro coil pockets 220 is made from a non-woven fabric. Micro coil spring 222 may be any conventional micro coil such as a single rate micro coil spring. As in other embodiments, pocket 212 of cushion pocket 210 is may be made from a non-woven fabric and connected to micro coil pockets 220 by an adhesive. As in other embodiments, resilient member 214 may be a foam cushion having any desired resiliency.

The present invention provides significant benefits over conventional mattresses. First, the use of pocket springs 90 significantly reduce the formation of indentations thereby providing a new mattress with increased comfort and useful life than conventional mattresses. Second, the use of pocket springs 90 provide better air circulation than conventional mattresses thereby resulting in the sleeper sleeping cooler. Third, the use of pocket springs 90 allow the softness or hardness of the cushion pockets above individual coil pockets to be selectively controlled thereby resulting in greater mattress customization choices for consumers desiring more complex cushioning profiles. This is achievable by varying the contents, dimensions, or number of cushion pockets within a string of pocket springs. Prior to this invention, it was possible to only vary the coil spring parameters on a coil by coil basis, but not the characteristics of the sheet foam cushioning material on a coil by coil basis. Fourth, the use of pocket springs 90 allow a single sided or a two sides mattress to be easily fabricated because the cushioning material is built into pocket springs 90 and does not require additional steps to insert and secure sheet cushioning material during the mattress fabrication. Fifth, the use of the pocket springs 90 minimizes the transmission of sleeper compressive forces in the plane that is orthogonal to that of the pocket springs helping to better isolate sleeper movements. Sixth, the use of the pocket springs 90 eliminates sheet cushioning layers that are subject to shear forces from sleeper compressive loads and their resultant premature failure, resulting in a longer life mattress. Seventh, the use of the pocket springs 90 eliminates sheet cushioning layers and replaces it with individually encased foam cushion pockets. Because the cushioned pockets are individually encased in a fabric, they are inherently impervious to trapping dust, dust mites, and other microorganisms, the health hazards associated with sheet cushioning materials on conventional mattresses are substantially reduced. Eighth, the use of the pocket springs 90 eliminates sheet cushioning layers and consequently reduces the quantity of cushioning material from between 20% to 25% relative to an existing pocket coil mattress that utilizes sheet cushioning material, thereby reducing corresponding cost and weight associated with the additional sheet cushioning material. All sheet cushioning material that lies between the pocket coils of a conventional mattress are eliminated by use of the pocket springs 90. Still further, pocket springs 90 allow the fabrication of a mattress without sheet cushioning layers that have been linked to the development of decubitus ulcers in patients in nursing homes and hospitals.

Accordingly, and by way of example only, the present invention is a mattress comprising a coil pocket comprising a pocket and a coil spring disposed therein. The mattress further comprises a first cushion pocket comprising a pocket and a resilient member disposed therein. The first cushion pocket is engaged with and acts directly upon the coil pocket. The first cushion pocket may be disposed above and juxtaposed to the coil pocket. The first cushion pocket is configured to produce a force. Substantially all of the force is transmitted to the coil pocket. The mattress may further a second cushion pocket comprising a pocket and a resilient member disposed therein. The second cushion pocket is engaged with and acts directly upon the coil pocket. The second cushion pocket may be below and juxtaposed to the coil pocket. The pockets of the coil pocket and the first and second cushion pockets are made from fabric. The coil spring may be a multi-rate coil spring. The resilient member may be a foam cushion. In another embodiment, the second cushion pocket may be engaged with and act directly upon the first cushion pocket. In this embodiment, the second cushion pocket is above and juxtaposed to the first cushion pocket. In another embodiment, the present invention is a spring unit comprising a first pocket spring and a second pocket spring. The first pocket spring comprises a coil pocket comprising a pocket and a coil spring disposed therein and a cushion pocket comprising a pocket and a resilient member disposed therein. The cushion pocket is engaged with and acts directly upon the coil pocket. The second pocket spring comprises a coil pocket comprising a pocket and a coil spring disposed therein. The second pocket spring further comprises a cushion pocket comprising a pocket and a resilient member disposed therein. The cushion pocket of the second pocket spring is engaged with and acts directly upon the coil pocket of the second pocket spring. In this embodiment, the pocket of the coil pocket of the first pocket spring is engaged with the pocket of the coil pocket of the second pocket spring. The pocket of the cushion pocket of the first pocket spring may be spaced apart from the pocket of the cushion pocket of the second pocket spring thereby allowing circulation of air. The resilient member of the cushion pocket of the first pocket spring comprises an resiliency R1. The resilient member of the cushion pocket of the second pocket spring comprises an resiliency R2. In this embodiment, resiliency R2 may be greater than resiliency R1. The resilient member of the cushion pockets of the first and second pocket springs may each comprise a foam cushion or material. The cushion pocket of the first pocket spring may be disposed above and juxtaposed to the coil pocket of the first pocket spring. The cushion pocket of the second pocket spring may be disposed above and juxtaposed to the coil pocket of the second pocket spring. In another embodiment, the present invention is a method or process of fabricating a pocket spring. The method comprises the steps of: (a) providing a first pocket; (b) inserting a coil spring into said first pocket; (c) providing a second pocket; and (d) inserting a resilient member into said second pocket. The method may further comprise a step (e) of attaching the second pocket to the first pocket. Step (e) further comprises the step of attaching the second pocket above the first pocket. Step (e) further comprises the step of delinating the pocket of the first cushion pocket with the pocket of the coil pocket. Step (e) further comprises the step of thermal bonding the pocket of the first cushion pocket with the pocket of the coil pocket. In another embodiment, the present invention is a mattress comprising (a) a coil layer comprising a plurality of coil pockets and (b) a cushion layer comprising a plurality of cushion pockets. The cushion layer is positioned so at least one of the cushion pockets engages with and acts directly upon at least one of the coil pockets.

Each of the coil pockets comprise a pocket and a coil spring disposed therein. Each of the cushion pockets comprise a pocket and a resilient member disposed therein. The cushion layer further comprises an attachment member. Each of the cushion pockets is engaged with the attachment member. The attachment member may be made of fabric. In another embodiment, the present invention is a method or process fabricating a mattress comprising the steps of: (a) providing a coil layer comprising a plurality of coil pockets; (b) providing a cushion layer comprising a plurality of cushion pockets; and (c) positioning at least one of said coil pockets to engage with and act directly upon at least one of said cushion pockets. The method further comprises a step (d) of attaching the second layer to at least one of the plurality of coil pockets. Step (d) further comprises the step of attaching the second layer above the plurality of coil pockets.

While particular embodiments of the invention have been shown and described, it will be obvious to those skilled in the art that changes and modifications may be made without departing from the scope of the claimed invention.

What is claimed is:

1. A spring unit comprising:

a first pocket spring comprising a coil pocket comprising a pocket and a coil spring disposed in said pocket and a cushion pocket comprising a pocket and a resilient member disposed in said pocket of said cushion pocket; said cushion pocket being engaged with and acting upon said coil pocket; said pocket of said coil pocket comprises a side portion, a bottom portion, and a top portion; said side portion extends from said bottom portion of said coil pocket to said top portion of said coil pocket; said pocket of said cushion pocket comprises a side portion, a bottom portion, and a top portion; said bottom portion of said pocket of said cushion pocket is connected directly to said top portion of said pocket of said coil pocket;

a second pocket spring comprising a coil pocket comprising a pocket and a coil spring disposed in said pocket of said coil pocket of said second pocket spring; said second pocket spring further comprising a cushion pocket comprising a pocket and a resilient member disposed in said pocket of said cushion pocket of said second pocket spring; said cushion pocket of said second pocket spring being engaged with and acting upon said coil pocket of said second pocket spring; said pocket of said coil pocket of said second pocket spring comprises a side portion, a bottom portion, and a top portion; said side portion of said pocket of said coil pocket of said second pocket spring extends from said bottom portion of said pocket of said coil pocket of said second pocket spring to said top portion of said pocket of said coil pocket of said second pocket spring; said pocket of said cushion pocket of said second pocket spring comprises a side portion, a bottom portion, and a top portion; said bottom portion of said pocket of said cushion pocket of said second pocket spring is connected directly to said top portion of said pocket of said coil pocket of said second pocket spring;

substantially the entire length of said side portion of said pocket of said coil pocket of said first pocket spring is engaged with substantially the entire length of said side portion of said pocket of said coil pocket of said second pocket spring;

said pocket of said cushion pocket of said first pocket spring is completely spaced apart and free from said pocket of said cushion pocket of said second pocket spring thereby allowing circulation of air.

2. The spring unit of claim 1, wherein said resilient member of said cushion pocket of said first pocket spring comprises a foam material and said resilient member of said cushion pocket of said second pocket spring comprises a foam material.

3. The spring unit of claim 2, wherein said pocket of said coil pocket of said first pocket spring and said pocket of said cushion pocket of said first pocket spring are formed by a thermal bond.

4. The spring unit of claim 3, wherein said pocket of said coil pocket of said second pocket spring and said pocket of said cushion pocket of said second pocket spring are formed by a thermal bond.

5. The pocket spring of claim 4, wherein said pocket of said cushion pocket of said first pocket spring is attached to said pocket of said coil pocket of said first pocket spring by adhesive.

6. The pocket spring of claim 5, wherein said pocket of said cushion pocket of said second pocket spring is attached to said pocket of said coil pocket of said second pocket spring by adhesive.

7. The pocket spring of claim 6, wherein said coil spring of said coil pocket of said first pocket spring is a multi-rate coil spring.

8. The pocket spring of claim 7, wherein said coil spring of said coil pocket of said second pocket spring is a multi-rate coil spring.

9. The pocket spring of claim 8, wherein said resilient member of said cushion pocket of said first pocket spring is a foam cushion.

10. The pocket spring of claim 9, wherein said resilient member of said cushion pocket of said second pocket spring is a foam cushion.

* * * * *